US005649853A

United States Patent [19]

Kuo

[11] Patent Number: 5,649,853

[45] Date of Patent: Jul. 22, 1997

[54] DRILL BIT GRINDING MACHINE

[76] Inventor: Chun-Lin Kuo, No. 34, Hsia-Tan Tsun, Lu-Tsao Hsiang, Chia-I Hsien, Taiwan

[21] Appl. No.: 681,499

[22] Filed: Jul. 23, 1996

[51] Int. Cl.[6] ..... B24B 7/00; B24B 9/00

[52] U.S. Cl. ..... 451/178; 451/48; 451/375; 451/212

[58] Field of Search ..... 451/178, 212, 451/213, 214, 375, 376, 403, 48

[56] References Cited

U.S. PATENT DOCUMENTS

| | | | |
|---|---|---|---|
| 2,866,302 | 12/1958 | Amiet | 451/375 |
| 3,341,981 | 9/1967 | Baronyak | 451/375 |
| 3,382,624 | 5/1968 | Folley | 451/212 |
| 3,656,264 | 4/1972 | MacKey, Jr. et al. | 451/48 |
| 3,680,263 | 8/1972 | Johnson | 451/48 |
| 3,711,997 | 1/1973 | Kushigian | 451/375 |
| 4,547,999 | 10/1985 | Reiling et al. | 451/375 |

FOREIGN PATENT DOCUMENTS

| | | | |
|---|---|---|---|
| 2206301 | 1/1989 | United Kingdom | 451/375 |

*Primary Examiner*—James G. Smith
*Assistant Examiner*—George Nguyen
*Attorney, Agent, or Firm*—Bacon & Thomas

[57] ABSTRACT

A drill bit grinding machine including a grinding control device controlled to move the drill bit, permitting it to be ground by the grinding wheel, the grinding control device including a mounting base, a coupling block pivoted to the mounting base to hold a bit holder, a side board coupled to the coupling block, a driven gear controlled to turn the bit holder, an axial movement control block controlled to move the bit holder axially, a tilt angle control device controlled to adjust the tilt angle of the bit holder, and a drive gear controlled to turn the driven gear and the tilt angle control device.

2 Claims, 11 Drawing Sheets

DRILL BIT GRINDING MACHINE

BACKGROUND OF THE INVENTION

The present invention relates to drill bit grinding machines, and relates more particularly to such a drill bit grinding machine which automatically grinds the stationary point and lip of the spur of the drill bit.

A drill bit is generally comprised of a shaft, a twist defining a spur, and a tip. The tip comprises two lips, two flanks, and a stationary point at the intersected end of the lips. The stationary point must be axially in perfect alignment with the axial axis of the drill bit so that the drill bit can be positively and accurately drilled into the workpiece. Because the stationary point of the drill bit wears quickly with use, the stationary point and the lips of the flank must be regularly ground. However, according to conventional grinding machines, the grinding of the stationary point and the grinding of the flanks of drill bit cannot be simultaneously completed, i.e., a secondary grinding process is needed to grind the flanks after the grinding of the stationary point. While grinding, the operator must use angle measuring means to measure the angle of the tip. This complicated grinding procedure greatly increases the grinding cost, and the grinding quality is difficult to be well controlled.

SUMMARY OF THE INVENTION

The main object of the present invention is to provide a high-performance, durable drill bit grinding machine which automatically grinds the stationary point and flanks of the tip of the drill bit through one grinding procedure. According to the preferred embodiment of the present invention, the drill bit grinding machine comprises a grinding control device controlled to move the drill bit, permitting it to be ground by the grinding wheel. The grinding control device comprises a mounting base, a coupling block pivoted to the mounting base to hold a bit holder, a side board coupled to the coupling block, a driven gear controlled to turn the bit holder, an axial movement control block controlled to move the bit holder axially, a tilt angle control device controlled to adjust the tilt angle of the bit holder, and a drive gear controlled to turn the driven gear and the tilt angle control device.

DETAILED DESCRIPTION OF THE PREFERRED EMBODIMENT

Figure 1:
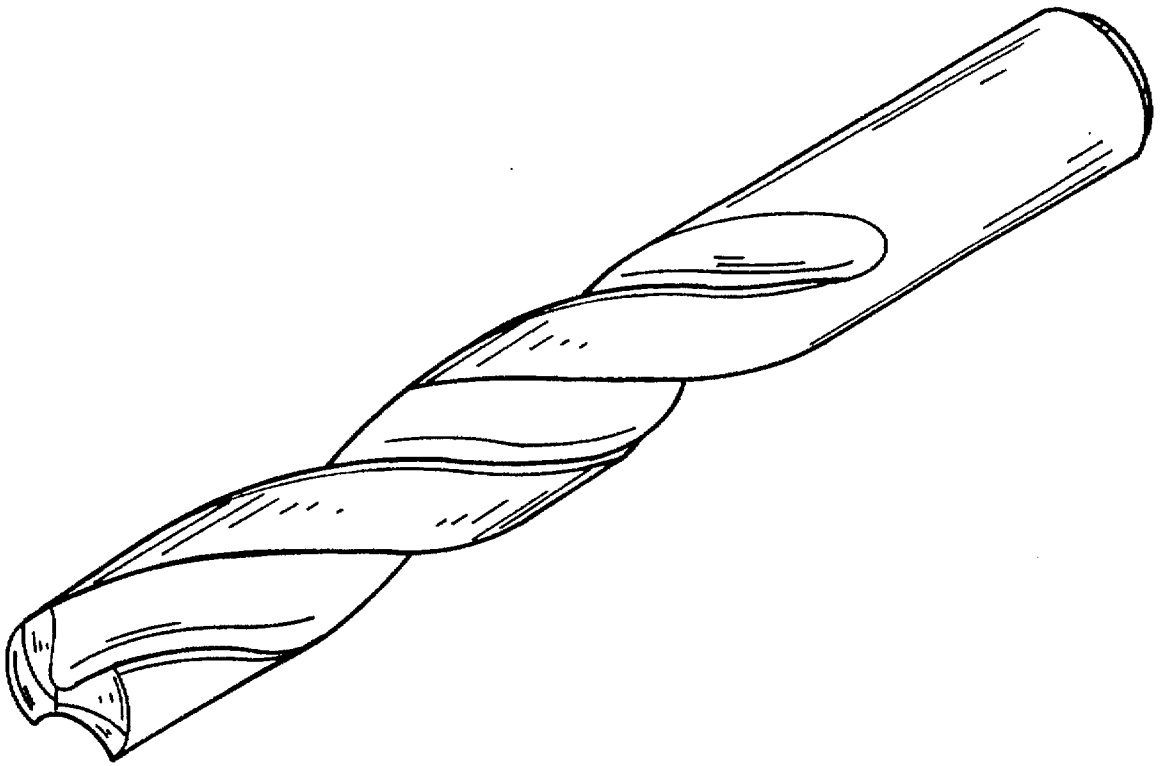
Fig. 1 PRIOR ART
FIG. 1 is an elevational view of a regular drill bit.
Figure 2:
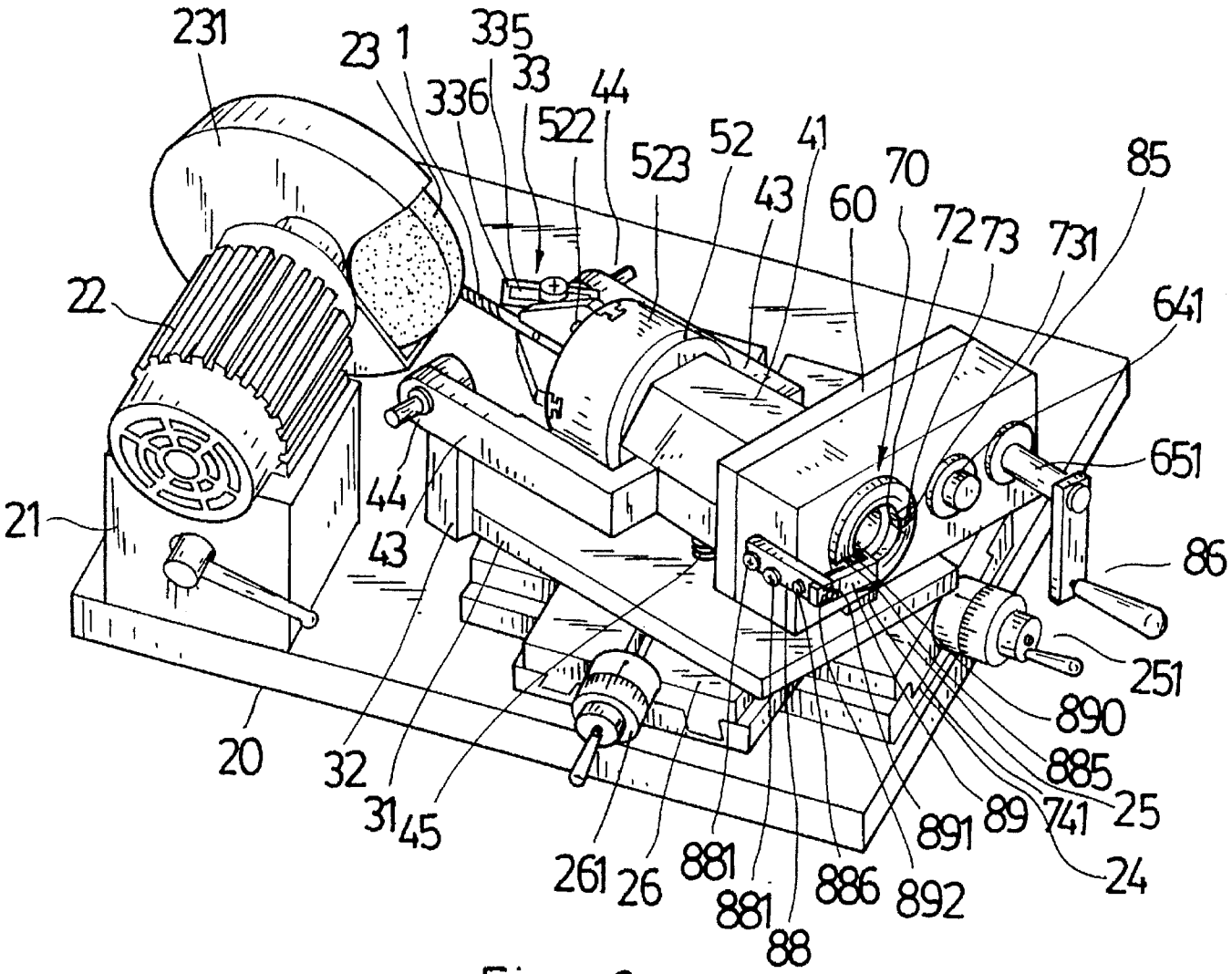
FIG. 2 is an elevational view of a drill bit grinding machine according to the present invention.
Figure 3A:
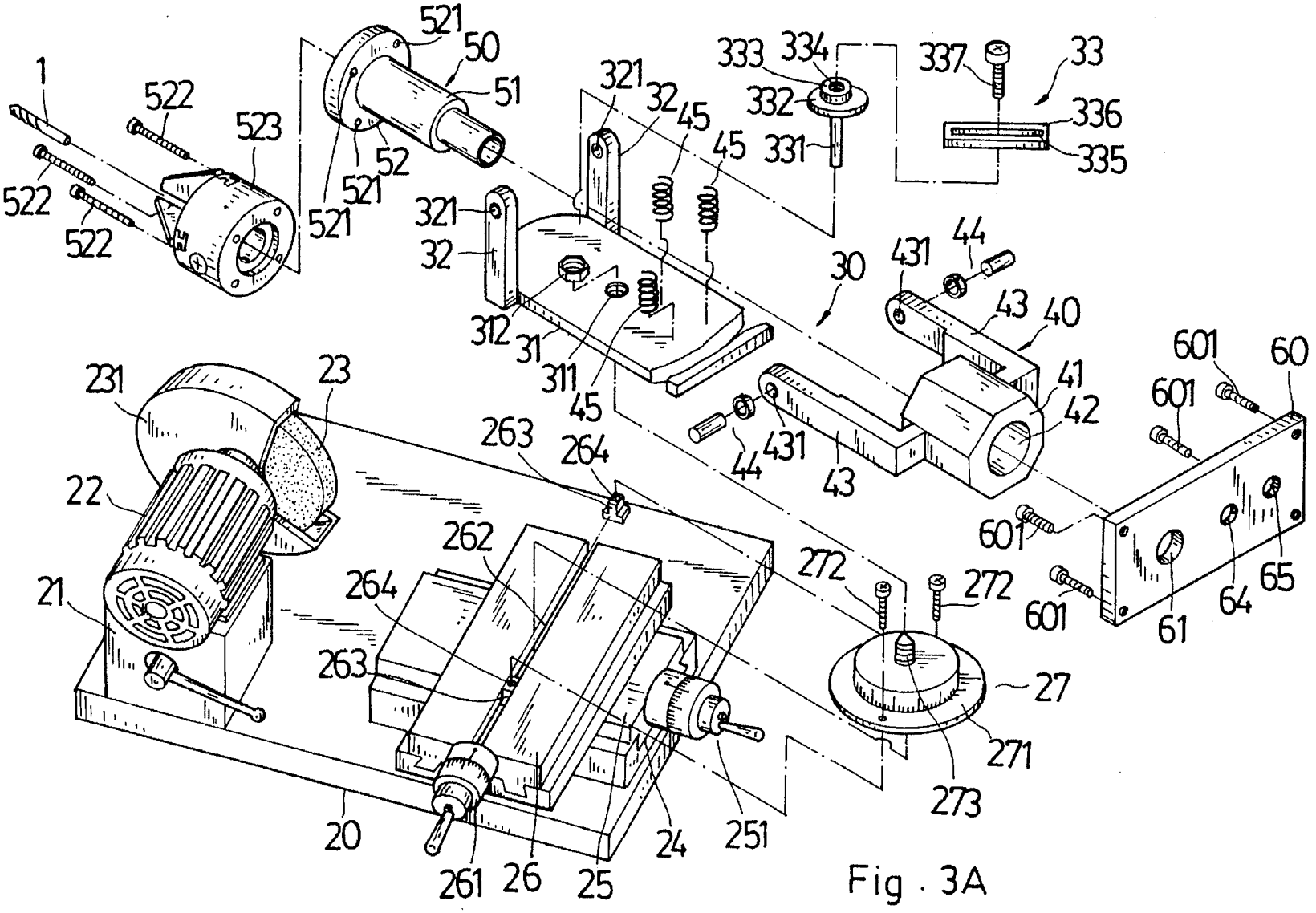
FIG. 3A is an exploded view of the drill bit grinding machine shown in FIG. 2 (Part I)

Referring to FIGS. 2 and 3A, a drill bit grinding machine in accordance with the present invention is generally comprised of a machine base 20, a mount 21 raised from the machine base 20 at the top near one side, a power drive (for example a motor) 22 mounted on the mount 21, a grinding wheel 23 coupled to the power drive 22 and turned by it, a guard 231 partially covered over the grinding wheel 23 for protection, a longitudinal dovetail groove 24 longitudinally raised from the machine base 20 at the top near an opposite side, a longitudinal dovetail slide 25 moved in the longitudinal dovetail groove 24 and having a transverse dovetail groove (not shown) at the top, a transverse dovetail slide 26 moved in the transverse dovetail groove of the longitudinal dovetail groove 24 and having a T-groove 262 invertedly disposed at the top along the longitudinal center line, two T-blocks 263 respectively sliding in the T-grooves 262 and having a respective top screw hole 264, index plate 27 fastened to the T-blocks 263, and a grinding control device 30 fastened to the index plate 27. The index plate 27 comprises a base 271 fastened to the screw holes 264 of the T-blocks 263 by fastening elements for example screws 272, and a connecting member for example a screw rod 273 at the center adapted for connecting to the grinding control device 30. The longitudinal dovetail slide 25 and the transverse dovetail slide 26 are controlled to move forwards and backwards in the respective dovetail grooves by a respective sliding control mechanism 251, 261.

Referring to FIGS. 2 and 3A again, the grinding control device 30 comprises a mounting base 31, a bit positioning device 33, a coupling block 40, a plurality of spring elements 45, and a bit holder 50. The mounting base 31 is a flat frame having a center through hole 311 fastened to the connecting member 273 of the index plate 27 by a fastening element for example a nut 312, two upright lugs 32 bilaterally disposed near the front end and and defining a respective pivot hole 321. The bit positioning device 33 is mounted on the mounting base 31 at the top near the front end, comprised of a mounting rod 331 fastened to the mounting base 31, a platform 332 at the top of the mounting rod 331, an upward projecting block 333 raised from the platform 332, a locating hole for example a screw hole 334 at the center of the upward projecting block 333, a horizontal rod 336 having an elongated slot 335, and a fastening element for example a screw 337 inserted through the elongated slot 335 of the horizontal rod 336 and threaded into the screw hole 334 of the projecting block 333 to secure the horizontal rod 336 in position. When the screw 337 is loosened, the horizontal position of the horizontal rod 336 can be adjusted. The coupling block 40 is mounted on the mounting base 31, comprised of a body 41 defining an axial through hole 42, two forward coupling arms 43 raised from two opposite sides of the body 41 and defining a respective pivot hole 431 respectively connected to the pivot holes 321 of the upright lugs 32 by a respective pivot 44. The spring elements 45 are respectively mounted on the mounting base 31 to support the body 41 of the coupling block 40. The bit bolder 50 comprises a stepped hollow shaft 51 inserted into the axial through hole 42 of the coupling block 40 and having a coupling flange 52 raised around one end, which coupling flange 52 having equiangularly spaced mounting holes 521, and a chuck 523 fastened to the mounting holes 521 of the coupling flange 52 by fastening elements 522 to hold the drill bit 1 to be ground. When the drill bit 1 is installed, the horizontal rod 336 of the bit positioning device 33 is adjusted to push the bit 1 into the grinding position. Before grinding, the horizontal rod 336 is moved away from the bit 1.

Figure 3B:
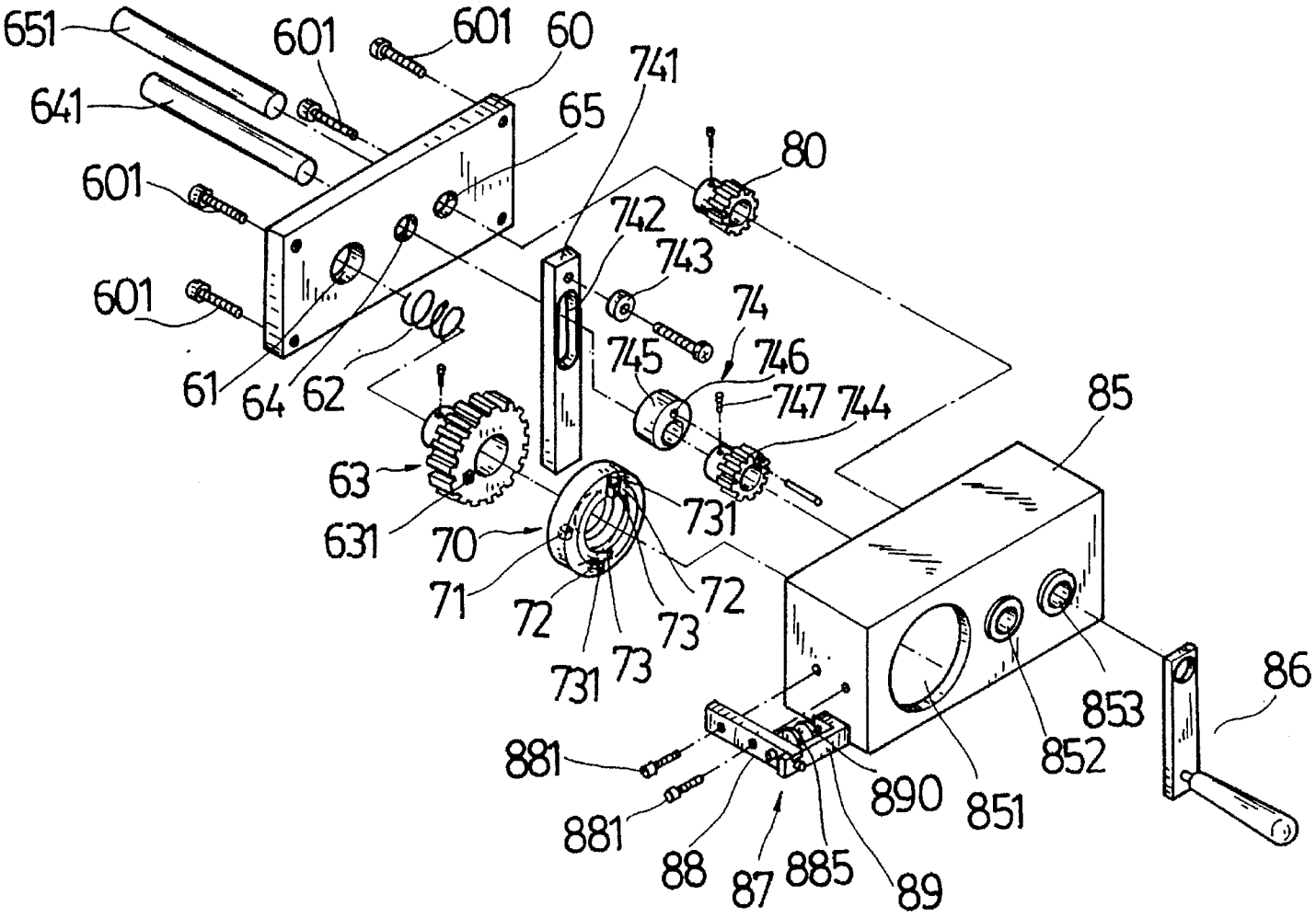
FIG. 3B is an exploded view of the drill bit grinding machine shown in FIG. 2 (Part II)
Figure 3C:
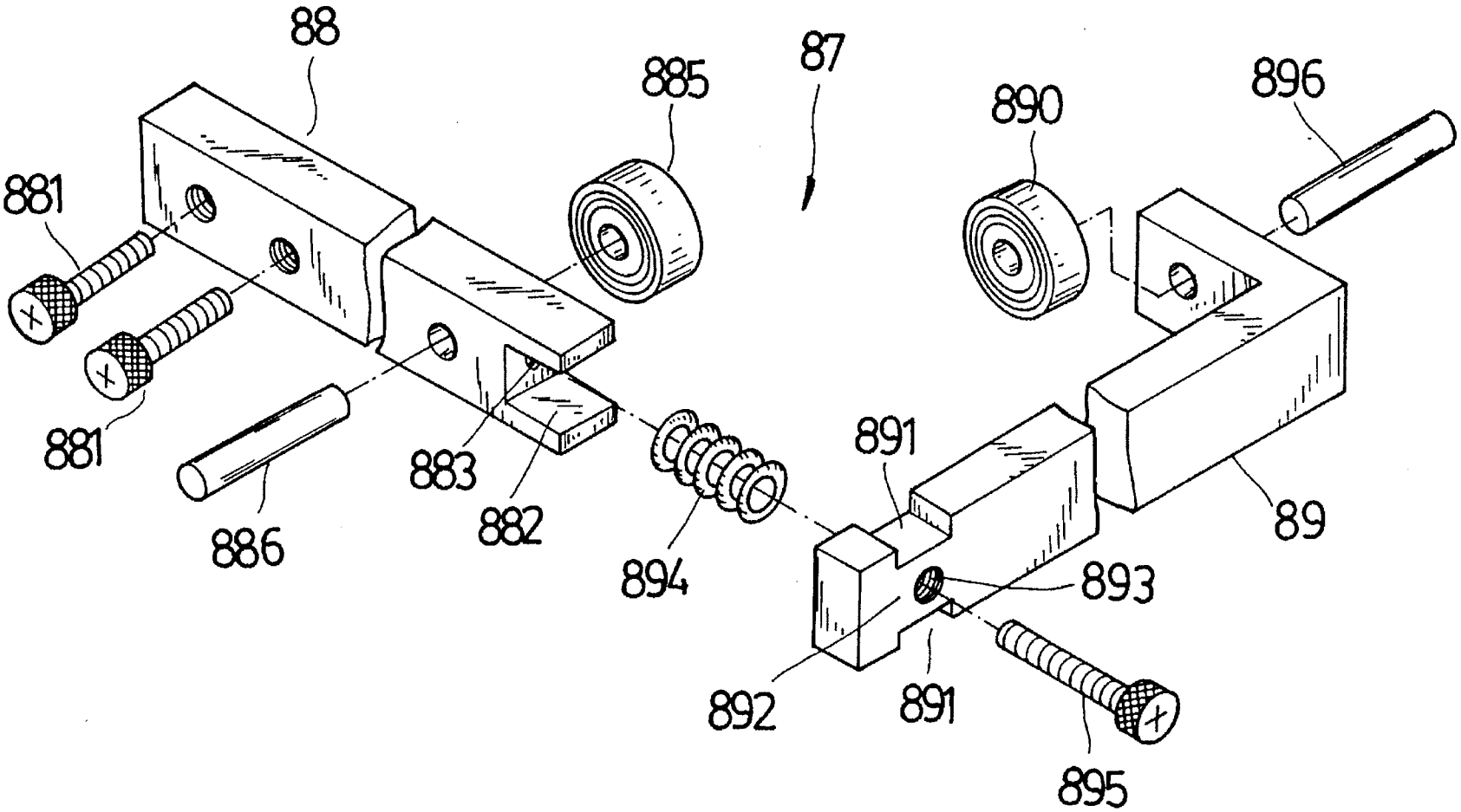
FIG. 3C is an exploded view of the locating mechanism of the grinding control device according to the present invention.
Figure 4:
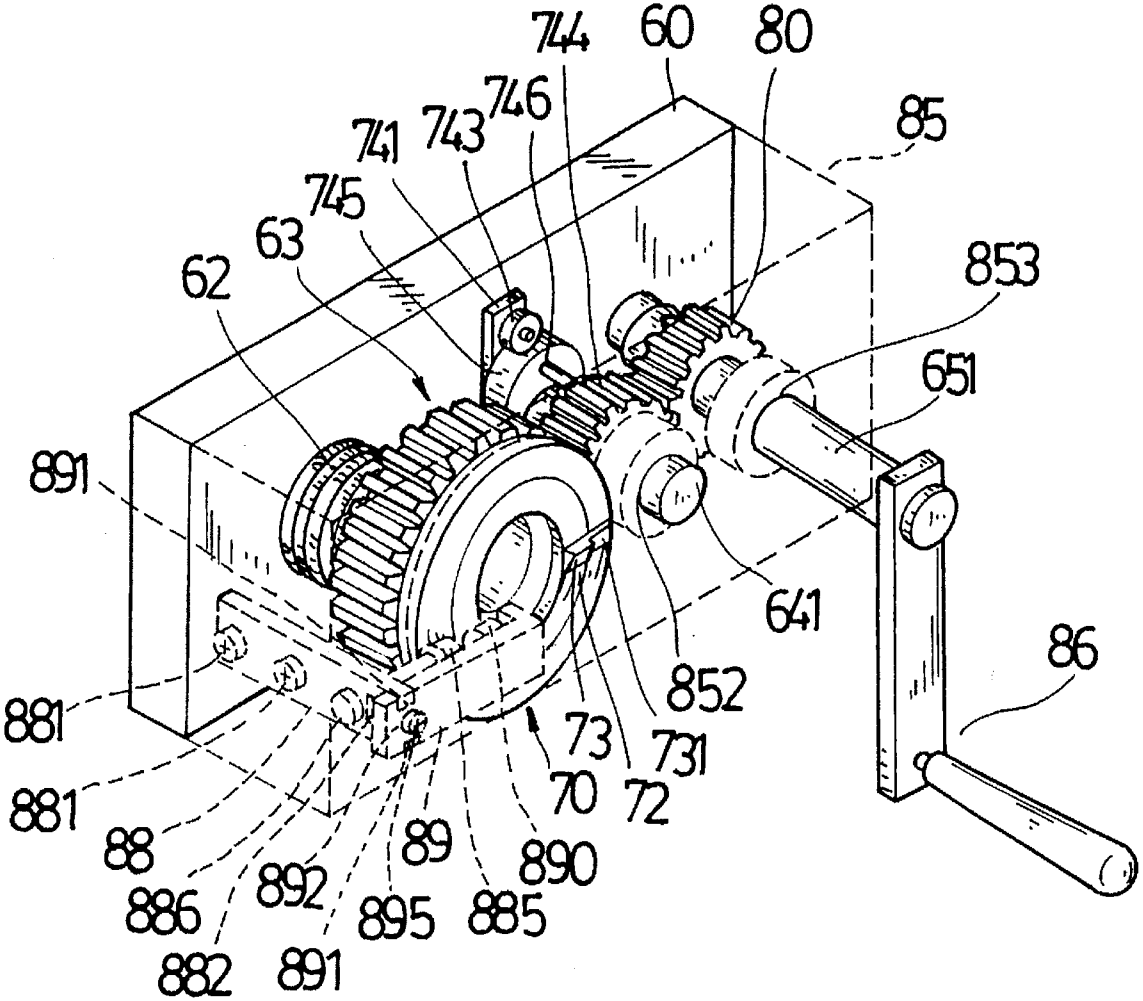
FIG. 4 is a perspective view of the side board, the side cover, and the related mechanism according to the present invention.
Figure 5:
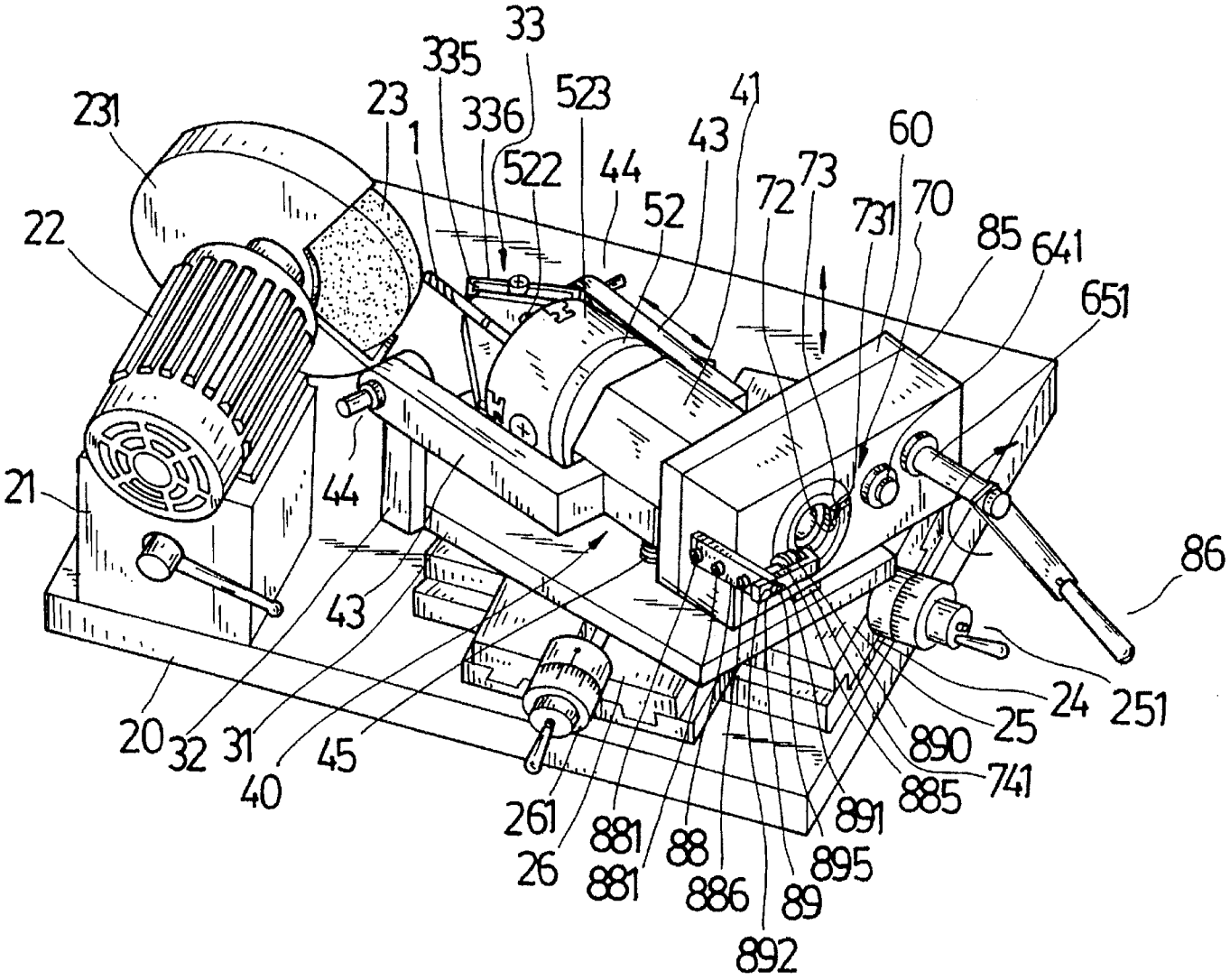
FIG. 5 is a perspective view of the present invention, showing the grinding machine operated.
Figure 6:
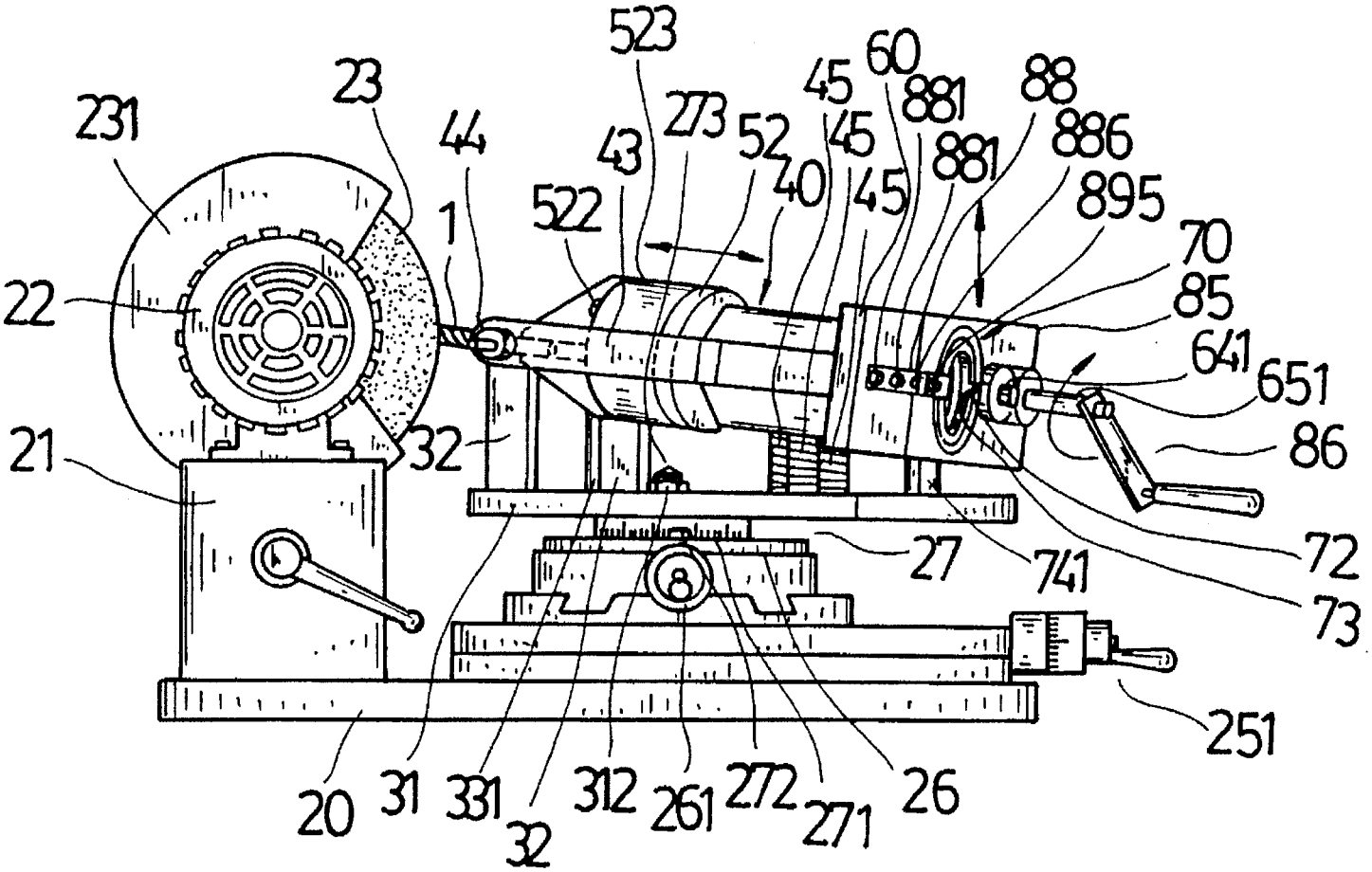
FIG. 6 is a side view of FIG. 5.
Figure 7A:
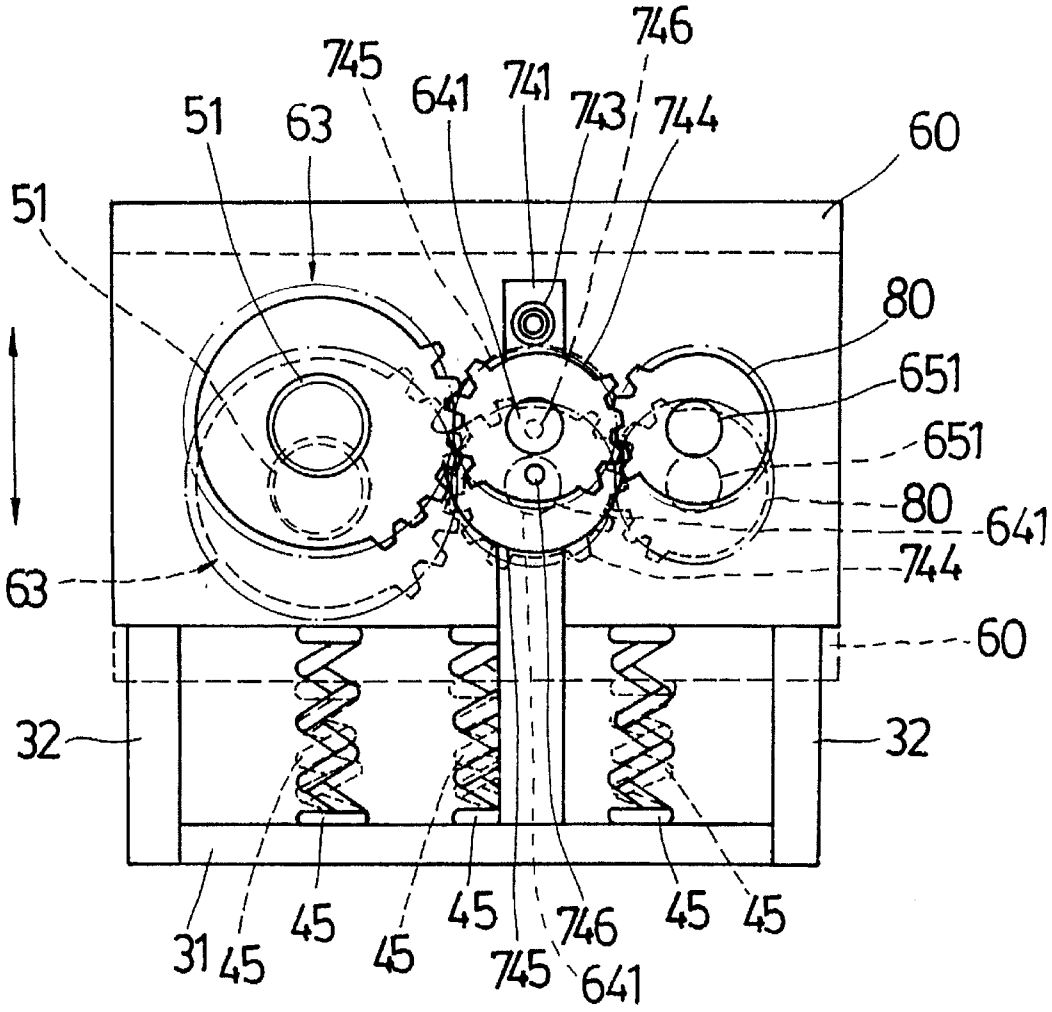
FIG. 7A is a front view of FIG. 4 when operated.
Figure 7B:
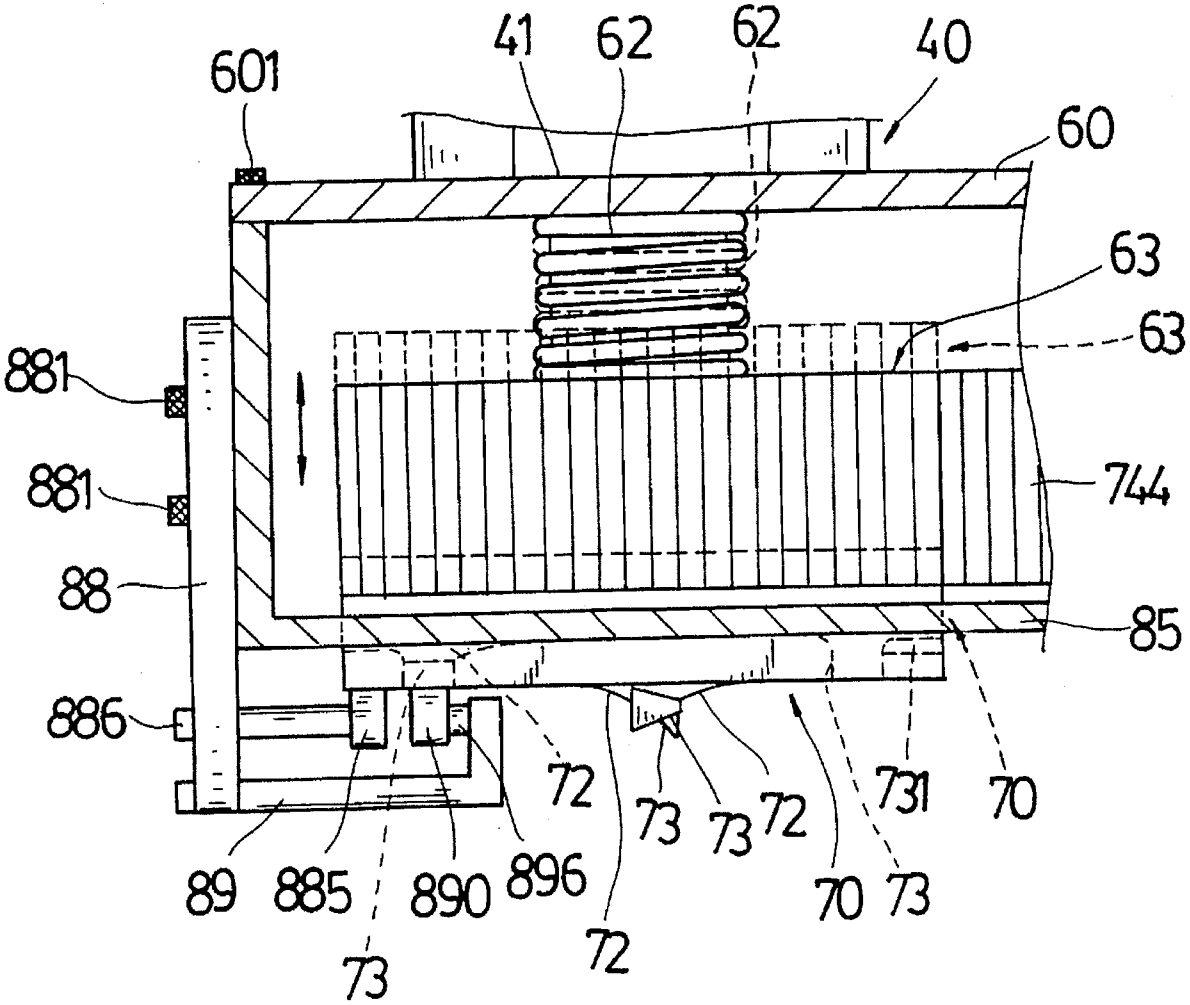
FIG. 7B is a top view of the axial movement control block and the linked mechanism according to the present invention.
Figure 8B:
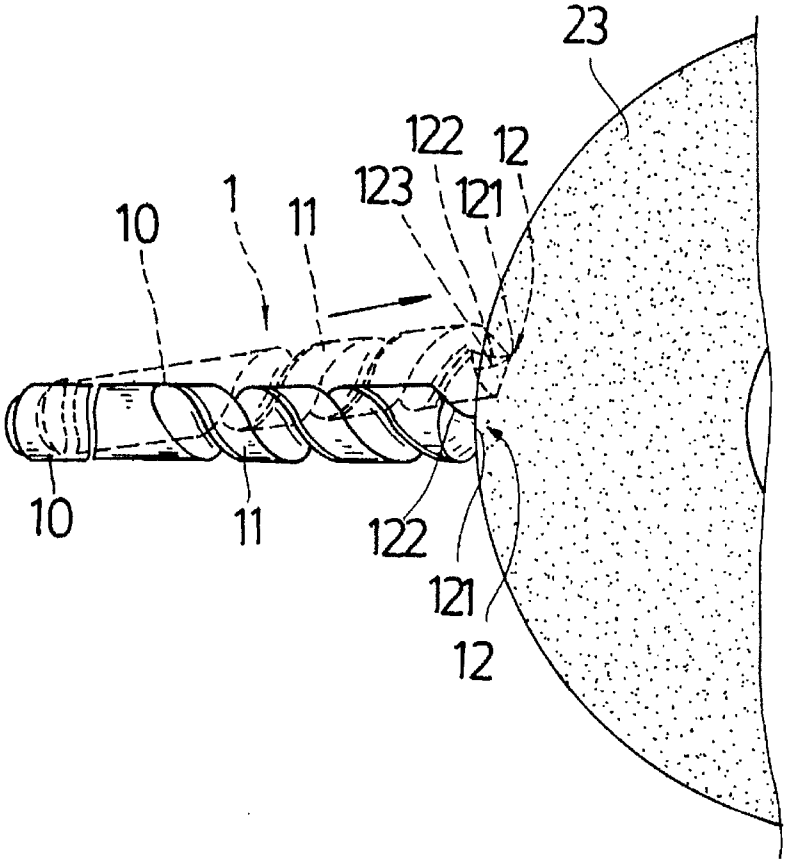
FIG. 8B shows the drill bit moved against the grinding wheel according to the present invention.
Figure 8A:
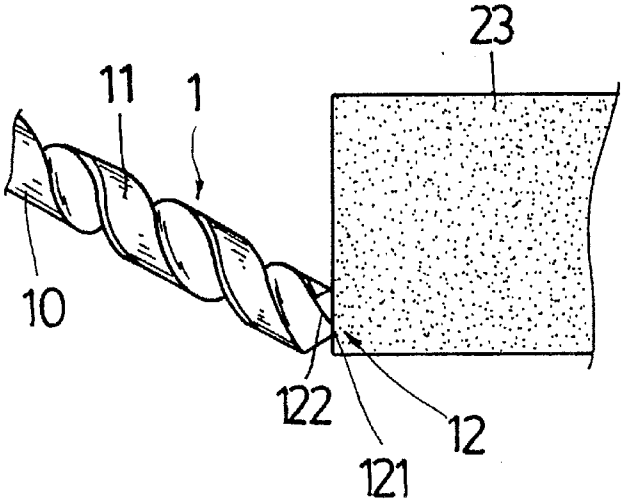
FIG. 8A is a top view showing the drill bit disposed in contact with the grinding wheel according to the present invention.

Referring to FIGS. 3B, 3C, and 4, a side board 60 is coupled to the coupling block 40 at one side remote from the bit holder 50. The side board 60 has a first through hole 61 through which the end of the stepped hollow shaft 51 is inserted, a second through hole 64, and a third through hole 65. A gear 63 is fixedly mounted around the end of the stepped hollow shaft 51, having a locating pin 631 at one side. A spring 62 is mounted around the stepped hollow shaft 51 and stopped between the side board 60 and the gear 63. A first axle 641 and a second axle 651 are respectively mounted in the second through hole 64 and third through hole 65 of the side board 60. An annular axial movement control block 70 is coupled to the gear 63 at one side, having a locating hole 71 coupled to the locating pin 631 of the gear 63, two spiral sloping surfaces 72 symmetrically disposed at two opposite sides, two conical blocks 73 respectively raised from the spiral sloping surfaces 72 at one end. Each of the conical blocks 73 has a slope 731 at one side. A tilt angle control device 74 is coupled to the first axle 641. The tilt angle control device 74 comprises an elongated block 741 vertically supported on the mounting base 31 of the grinding control device 30 and having an elongated slot 742 coupled to the first axle 641, a gear 744 fixedly mounted around the first axle 641, a bearing 743 fixedly mounted on the elongated block 741 at one side above the elongated slot 742, a cam 745 mounted around the first axle 641 and disposed in contact with the bearing 743 and having a locating hole 746 fixedly connected to the gear 744 by a locating pin 747. A drive gear 80 is mounted on the second axle 651. The tooth ratio between the drive gear 80, the gear 744, and the gear 63 is 1:1:2. A side cover 85 is covered on the side board 60 over the gears 63, 744 and the drive gear 80. The side cover 85 has a first through hole 851, a second through hole 852, and a third through hole 853 respectively aligned with the first through hole 61, second through hole 64, and third through hole 65 of the side board 60. The first through hole 851 of the side cover 85 receives the annular axial movement control block 70. The second through hole 852 and the third through hole 853 receive the first axle 641 and the second axle 651 respectively. The bottom side of the side cover 85 has an opening (not shown) through which the bottom end of the elongated block 741 passes. A driving device for example a crank handle 86 is coupled to the second axle 651 outside the side cover 85. A locating mechanism 87 is mounted on the side cover 85 on the outside near the axial movement control block 70. As illustrated in FIG. 3C, the locating mechanism 87 comprises a rectangular mounting block 88 fixedly secured to one side of the side cover 85 by fastening elements 881, and a bearing block 89 fixedly and perpendicularly connected to the rectangular mounting block 88. The rectangular mounting block 88 has a mouth 882 at one end, and an axial mounting hole 883 in the mouth 882. The bearing block 89 comprises two recessed portions 891 bilaterally disposed at one end and defining a coupling neck 892, and a mounting hole 893 in the coupling neck 892. The coupling neck 892 is coupled to the mouth 882 of the rectangular mounting block 88, permitting the mounting hole 893 of the coupling neck 892 to be connected to the axial mounting hole 883 of the rectangular mounting block 88 by adjustment element for example an adjustment screw 895. A spring 894 is mounted around the adjustment device 895 and stopped between the rectangular mounting block 88 and the bearing block 89. The opposite end of the bearing block 89 is turned inwards at right angles and mounted with an axle 896 to hold a bearing 890. The rectangular mounting block 88 is also mounted with an axle 886 to hold a bearing 885. When assembled, the bearings 890, 885 are respectively disposed in contact with the spiral sloping surfaces 72 and conical blocks 73 of the axial movement control block 70.

The operation of the present invention is outlined hereinafter with reference to FIGS. 5, 6, 7A, and 7B. The angle of the grinding control device 30 is adjusted through the index plate 27, then the sliding control mechanisms 251, 261 are respectively adjusted to move the grinding control device 30 to the desired grinding position, permitting the drill bit 1 to be forced into contact with the grinding wheel 23, and then the crank handle 86 is driven to turn the drive gear 80 clockwise, causing it to turn the gears 744, 63 (the gear 744 is meshed between the drive gear 80 and the gear 63). When the gear 744 is rotated, the cam 745 and the first axle 641 are simultaneously rotated. Because the cam 745 is disposed in contact with the bearing 743 and the bearing 743 is fixedly mounted on the elongated block 741, the thrust is transmitted from the cam 745 to the first axle 641, thereby causing the first axle 641 to carry the side board 60 downwards and upwards. When the side board 60 is lowered, the coupling block 40 is forced to turn downwards and to compress the springs 45. When the coupling block 40 is turned downwards, the bit holder 50 is tilted upwards. Therefore, when the cam 745 is continuously turned, the first axle 641 is moved in the elongated slot 742 of the elongated block 741 up and down, and the coupling block 40 is alternatively turned downwards and upwards. When the gear 744 is turned by the drive gear 80 through one run, the gear 63, the axial movement control block 70 and the bit holder 50 are turned through 180× angle, and the bearing 890 is forced into contact with one spiral sloping surface 72 and one conical block 73. Because the bearing 890 is fixed to the bearing block 89, the axial movement control block 70 will be pushed inwards to force the gear 63 toward the side board 60 against the spring 62 when the bearing 890 is forced against the axial movement control block 70, and at the same time, the chuck 523 of the bit holder 50 is forced to move the drill bit 1 forwards to a certain distance. When the conical block 73 passes through the bearing 890, the bearing 885 becomes unable to push the axial movement control block 70, and the axial movement control block 70 is forced by the spring 62 to move the bit holder 50 back to its former position, and therefore the chuck 523 is moved to carry the drill bit 1 out of the grinding position. Furthermore, the position of the bearing 890 relative to the bearing 885 can be adjusted by adjusting the adjustment device 895, for permitting the bearing 890 or 885 to be controlled to push the axial movement control block 70 subject to the specification of the drill bit to be ground.

Therefore, when the crank handle 86 is driven to turn the shank 10 of the drill bit 1 relative to the grinding wheel 23, the tip 12 of the twist 11 is turned against the grinding wheel 23. When the drill bit 1 is turned through 180× angle, the grinding control device 30 is simultaneously driven to feed the drill bit 1 forwards, thereby causing the grinding wheel 23 to grind one lip 122 and one flank 123 of the tip 12. The drill bit 1 is then moved out of the grinding position, and then moved forwards and turned through a next 180× angle, permitting the other lip 122 and the other flank 123 of the spur 12 to be ground. Therefore, the stationary point 121, lips 122, and flanks 123 are well ground in one grinding procedure.

What the invention claimed is:

1. A drill bit grinding machine comprising a machine base, a mount raised from said machine base, a power drive mounted on said mount, a grinding wheel turned by said power drive, a longitudinal dovetail groove longitudinally raised from said machine base, a longitudinal dovetail slide controlled by a sliding control device to move in said longitudinal dovetail groove and having a transverse dovetail groove, a transverse dovetail slide controlled by a sliding control device to move in the transverse dovetail groove of said longitudinal dovetail groove, an index plate mounted on said transverse dovetail slide, and a grinding control device fastened to said index plate, wherein said grinding control device comprises:

a mounting base having a center through hole fastened to said index plate, two upright lugs bilaterally disposed at one end, each of said upright lugs defining a respective pivot hole;

a coupling block mounted on said mounting base, said coupling block comprising a body defining an axial through hole, two forward coupling arms raised from two opposite sides of said body and defining a respective pivot hole respectively connected to the pivot holes of the upright lugs of said mounting base by a respective pivot, and a plurality of spring elements at a bottom side thereof respectively supported on said mounting base;

a bit holder coupled to said coupling block, said bit holder comprising a stepped hollow shaft inserted into the axial through hole of said coupling block and having a coupling flange raised around one end, said coupling flange having equiangularly spaced mounting holes, and a chuck fastened to the mounting holes of said coupling flange and adapted for holding the drill bit to be ground;

a side boards coupled to said coupling block at one side remote from said bit holder, said side board having a first through hole through which said stepped hollow shaft is inserted, a second through hole, and a third through hole;

a transmission gear fixedly mounted around said stepped hollow shaft;

a spring mounted around said stepped hollow shaft and stopped between said side board and said transmission gear;

a first axle and a second axle respectively mounted in the second through hole and third through hole of said side board;

an annular axial movement control block fixedly coupled to said transmission gear at one side, having two spiral sloping surfaces symmetrically disposed at two opposite sides, and two conical blocks respectively raised from said spiral sloping surfaces at one end, each of said conical blocks having a slope at one side;

a tilt angle control device coupled to said first axle, said tilt angle control device comprising an elongated block vertically supported on said mounting base and having an elongated slot coupled to said first axle, a driven gear fixedly mounted around said fist axle and meshed with said transmission gear, a bearing fixedly mounted on said elongated block at one side above said elongated slot, a cam mounted around said first axle and disposed in contact with the bearing of said tilt angle control device;

a drive gear mounted on said second axle and meshed with said transmission gear at one side opposite to said driven gear, the ratio of number of teeth between said drive gear, said transmission gear, and said driven gear being 1:1:2;

a side cover covered on said side board, said side cover comprising a first through hole which receives said annular axial movement control block, a second through hole which receives said first axle, and a third through hole which receives said second axle;

a driving device coupled to said second axle outside said side cover and adapted for turning said second axle and said drive gear; and a locating mechanism mounted on said side cover on the outside and having at least one bearing abutted against said axial movement control block.

2. The drill bit grinding machine of claim 1 wherein said locating mechanism comprises a rectangular mounting block fixedly secured to one side of said side cover, and a bearing block fixedly and perpendicularly connected to said rectangular mounting block, said rectangular mounting block having a mouth at one end, and an axial mounting hole in said mouth, said bearing block comprising a coupling neck coupled to the mouth of said rectangular mounting block, a mounting hole in said coupling neck connected to the axial mounting hole of said rectangular mounting block, an adjustment device fastened to the mounting hole of said bearing block and the axial mounting hole of said rectangular mounting block and controlled to adjust the position of said bearing block relative to said rectangular mounting block, a spring mounted around said adjustment device and stopped between the rectangular mounting block and said bearing block, and two bearings respectively mounted on said rectangular mounting block and said bearing block and disposed in contact with the spiral sloping surfaces and conical blocks of said axial movement control block.

* * * * *